United States Patent [19]

Joseph

[11] Patent Number: 5,042,440

[45] Date of Patent: Aug. 27, 1991

[54] CYLINDER HEAD FOR INTERNAL COMBUSTION ENGINE

[76] Inventor: Robert C. Joseph, 231 Shadowlawn Rd., Marietta, Ga. 30067

[21] Appl. No.: 511,757

[22] Filed: Apr. 20, 1990

[51] Int. Cl.[5] ..... F02B 23/00

[52] U.S. Cl. ..... 123/193 H; 123/193 CH

[58] Field of Search ..... 123/193 H, 193 CH, 306, 123/657, 188 M, 198 E

[56] References Cited

U.S. PATENT DOCUMENTS

| | | | |
|---|---|---|---|
| 4,686,948 | 8/1987 | Smith et al. | 123/193 H |
| 4,699,092 | 10/1987 | Ruf et al. | 123/193 H |
| 4,763,619 | 8/1988 | Eitel et al. | 123/193 CH |
| 4,883,030 | 11/1989 | Tanahashi et al. | 123/193 CH |
| 4,938,183 | 7/1990 | Field et al. | 123/193 CH |

FOREIGN PATENT DOCUMENTS

| | | | |
|---|---|---|---|
| 2617938 | 11/1976 | Fed. Rep. of Germany | 123/193 H |

*Primary Examiner*—Andrew M. Dolinar
*Assistant Examiner*—Marguerite Macy
*Attorney, Agent, or Firm*—Kimmel, Crowell & Weaver

[57] ABSTRACT

A cylinder head for an internal combustion engine has a substantially greater height than conventional cylinder heads, and intake and exhaust ports which extend angularly upwardly in the head from the combustion chamber to a respective surface of the head. Intake and exhaust valves are provided in the head for controlling flow through the intake and exhaust ports, and the valves are tilted both longitudinally and laterally with respect to the head. The intake and exhaust ports are skewed in the head to closely align the axes of the ports with the angle of the respective valves. Valve operating components are recessed into the top surface of the head, enabling a flat valve cover to be used for enclosing the valve operating components. The invention is particularly directed to a cylinder head having a generally wedge-shaped combustion chamber, and the height of the head in a specific construction is about six inches, with the intake ports angled upwardly at about 30° and the exhaust ports angled upwardly at about 60°. The ports are longer and straighter in the head of the invention than in conventional heads, resulting in improved flow of intake and exhaust gases.

6 Claims, 7 Drawing Sheets

CYLINDER HEAD FOR INTERNAL COMBUSTION ENGINE

FIELD OF THE INVENTION

This invention relates to internal combustion engines, and more particularly, to an improved cylinder head for high performance engines.

DESCRIPTION OF THE PRIOR ART

Ever since the advent of internal combustion engines, there has been continuing effort to improve the performance and/or economy of operation of such engines. These efforts have included supercharging, turbocharging, fuel injection, improved carburetors, streamlined exhaust headers, special intake manifold designs, special combustion chamber shapes, multiple intake and exhaust valves for each cylinder, and the like. Individuals and groups involved in racing have also developed ingenious modifications to valve and port designs, the use of special materials for lighter weight and better performance, and similar modifications to basic engines.

Most of these efforts have been based on conventional engine technology, including essentially standard overall cylinder head configurations, albeit with improved ports and valves and the like. Cylinder head improvements generally involve polishing and shaping the existing ports and valve seats to obtain improved flow of the incoming air/fuel mixture and the outgoing exhaust gases.

Conventional cylinder heads of the so-called wedge type generally have an overall height or thickness on the order of about three inches. Intake ports enter through one side of the head and lead to the generally wedge shaped combustion chamber on the bottom surface of the head, while exhaust ports lead from the combustion chamber through the side of the head opposite the intake ports. The relatively low height of the head requires that the intake and exhaust ports bend through a relatively sharp radius in order to enter the combustion chamber at an angle aligned as closely as possible with the axis cf the respective intake and exhaust valves. The intake port, for example, typically extends nearly parallel with the bottom surface of the head over a substantial portion of its length, taking the shortest path to the adjacent head surface. Similarly, the exhaust port may be curved throughout its length. This sharp radius and the relatively short length of the intake and exhaust ports hinders flow of gases into and out of the combustion chamber, impairing performance and economy of operation.

Moreover, the valve train sits on top of the relatively "short" conventional cylinder heads, requiring an upstanding valve cover and gasket seals in order to prevent oil leaks.

The spark plug in conventional wedge head designs also enters the combustion chamber at an angle that is usually directed toward the intake valve. This requires an advance of 38° or more to the ignition spark in high performance engines in order to obtain adequate burn of the air/fuel mixture in the combustion chamber.

Other problems encountered in conventional cylinder head designs include shrouding of the intake and exhaust valves, and uneven burn or flame travel through the combustion mixture within the combustion chamber. Shrouding is the effect produced by too close positioning of the edge of the valve relative to the side of the combustion chamber, or other shielding of the valve, with the result that flow of gases around the valve is impeded in that area of the valve.

One example of a prior art cylinder head which attempts to overcome at least some of the above-identified problems is described in U.S. Pat. No. 4,73,382. In this patent, a special shape is given to the roof of the combustion chamber. Specifically, a built-up area is provided at the juncture between the intake and exhaust valve seats to shape and improve exhaust flow. Special shaping is also given to the intake port to increase the velocity of the air/fuel mixture. However, the head is still of relatively "short" height, and the length of the intake and exhaust ports is therefore substantially conventional. That is, the ports are short, and the intake port also bends through a sharp angle as it approaches the combustion chamber. Thus, although this head represents an improvement over conventional prior art designs, it still does not achieve the maximum performance potential possible with a wedge head design.

SUMMARY OF THE INVENTION

Accordingly, it is an object of the present invention to provide an improved cylinder head having generally wedge shaped combustion chambers, which is taller than conventional heads and thus enables longer and straighter intake and exhaust ports and concomitant improved flow of both intake and exhaust gases, as well as better mixing of the air/fuel mixture.

Another object is to provide a cylinder head having intake and exhaust ports which are relatively straight and are angled upwardly in the head for more close alignment with the respective intake and exhaust valves to improve flow of intake and exhaust gases.

A further object is to provide a cylinder head in which the combustion chamber shape and positioning of the spark plug enhances flame travel through the combustion gases, enabling the ignition spark to be less advanced than in conventional designs, thereby producing more power.

A still further object of the invention is to provide a cylinder head in which the valve train is recessed into the top surface of the head, enabling more effective sealing of the valve cover.

A more specific object of the invention is to provide a cylinder head in which the intake and exhaust ports are twisted or skewed in the head so that they extend angularly from the respective head surfaces to the combustion chamber, enabling them to be essentially straight and aligned axially wi&:h the respective valve, thus improving flow while at the same time producing a swirling action in the intake gas and achieving thorough admixing of the air and fuel.

An even further object of the invention is to provide a cylinder head which has an increased height relative to conventional heads, enabling the intake and exhaust ports to be straightened out and lengthened for achieving improved flow characteristics, and providing space for recessing the valve train components into the top surface of the head.

Yet another object of the invention is to provide a cylinder head for so-called big block engines, or engines having a displacement greater than about 400 cubic inches, which has a relatively small combustion chamber volume on the order of about 60 cc.

In carrying out the above and other objects and advantages of the invention, a cylinder head in accordance with the invention may either be cast or made from a billet. The intake and exhaust ports extend upwardly at an angle from the combustion chamber to their respective sides of the head, and are relatively straight throughout their length, curving through a large radius turn just above the valves. The ports are longer than the ports on conventional heads, and are aligned substantially axially with the respective intake and exhaust valves. The ports are also skewed in the heads so that they align more closely with the axis of the respective valves, thereby improving the shape of the ports and thus enhancing flow of gases through the ports.

The intake and exhaust valves are also angled in the head so as to be aligned closely with the axes of the intake and exhaust ports, and the faces of the valves subtend an angle of only about 12° with respect to the face or bottom of the head.

A head constructed in accordance with the invention has a height approximately the same as its width. More specifically, the present invention is directed to a cylinder head of the so called wedge type, in which the combustion chamber is generally wedge shaped. Such heads typically have a width of about seven inches. The head of the invention has a height of about six inches.

The inlet end of the intake port is raised approximately two inches from the bottom surface of the head, and the outlet end of the exhaust port is raised about three inches from the bottom surface. This results in the intake port extending upwardly from the combustion chamber at an angle of about 30°, and the exhaust port extends upwardly at an angle of about 60°. Obviously, these specific angles will vary depending upon the specific dimensions of the head, but in any event the ports extend upwardly and away from the combustion chamber and thus align more closely with the axes of the respective valves. In a head having this height, and with the ports raised as described, the ports are exceptionally straight and long in comparison with conventional head designs. For instance, the roof of the intake port or runner has a length of about seven and one-half inches, while the floor of the runner has a length of about four and one-half inches. The roof of the exhaust port or runner has a length of about five and five-eighth inches, while the floor of the exhaust port or runner has a length of about three and one-quarter inches.

The combustion chamber in the head of the invention preferably has a volume of only about 60 cc, as compared with conventional heads for big block engines, in which the combustion chamber typically has a volume of 75 cc or greater.

The spark plug enters the combustion chamber substantially midway between the intake and exhaust valves and is angled toward the exhaust valve to promote burning of the air/fuel mixture.

In a head having the above dimensions, and with an intake valve diameter of 2.375 inches and exhaust valve diameter of 1.940 inches, approximately two to three horsepower per cubic inch of displacement can be obtained on a conventionally aspirated gasoline burning engine. In a supercharged alcohol fuel burning engine, approximately five horsepower per cubic inch displacement can be obtained.

BRIEF DESCRIPTION OF THE DRAWINGS

The foregoing objects of the invention, as well as other objects and advantages, will become apparent from the following detailed description when considered in conjunction with the accompanying drawings, in which like reference characters designate like parts throughout the several views, and wherein.

DETAILED DESCRIPTION OF THE PREFERRED EMBODIMENTS

Figure 1:
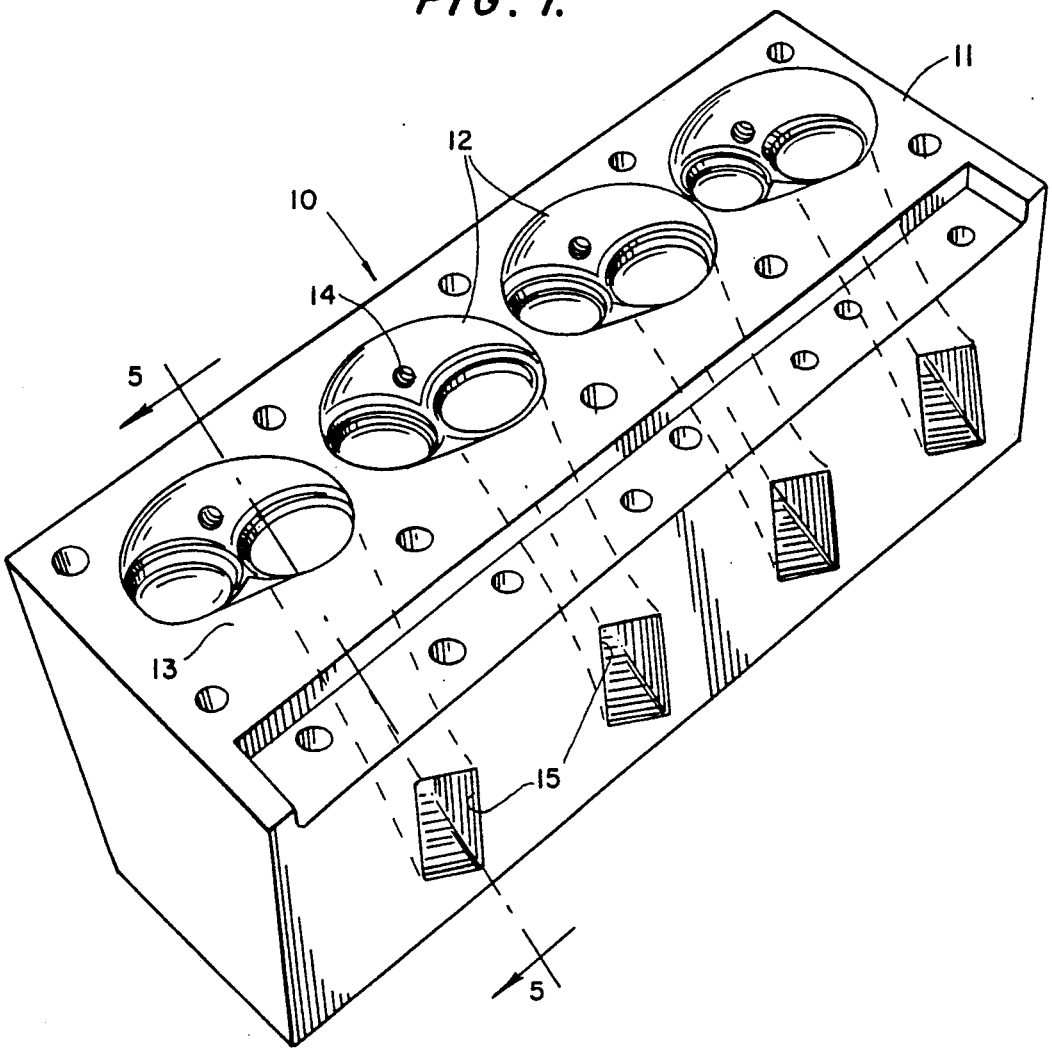
FIG. 1 is a bottom perspective view of a cylinder head in accordance with the invention, looking toward the intake side.

Referring more specifically to the drawings, a cylinder head in accordance with the invention is indicated generally at 10. The cylinder head may be cast or formed from a billet, and includes a bottom surface which is machined or otherwise finished for mating engagement with an engine block B (FIGS. 3–7) to close the upper ends of the cylinders C in the block.

A plurality of combustion chambers 12 of approximately kidney shape in plan view are formed in equally spaced relationship along the surface 11 for mating cooperation with the upper ends of the cylinders. The combustion chambers 12 are of the wedge type, tapering from a burn control surface or quench zone 13 at one side of the chamber and that is coplanar with the surface 11, to a maximum height of about $\frac{5}{8}$ of an inch where spark plug opening 14 enters through the roof of the chamber, and thence curving downwardly to the opposite side of the chamber. In a preferred construction, the combustion chamber has a volume of only 60 cc, much smaller than the volume of the combustion chamber in conventional heads for large block engines, which may exceed 75 cc.

Figure 4:
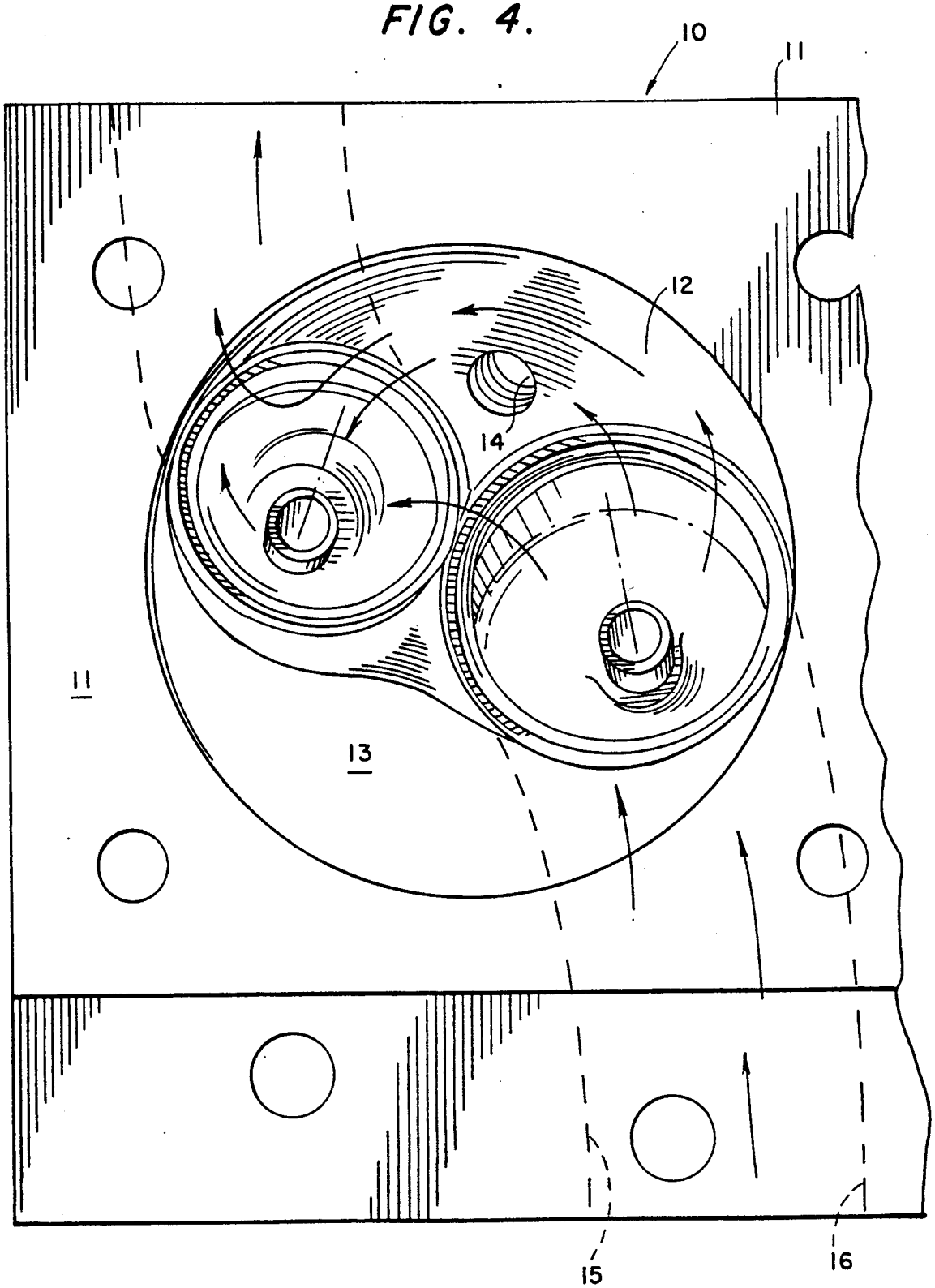
FIG. 4 is a greatly enlarged, fragmentary bottom plan view of one of the combustion chambers of the head of the invention.
Figure 6:
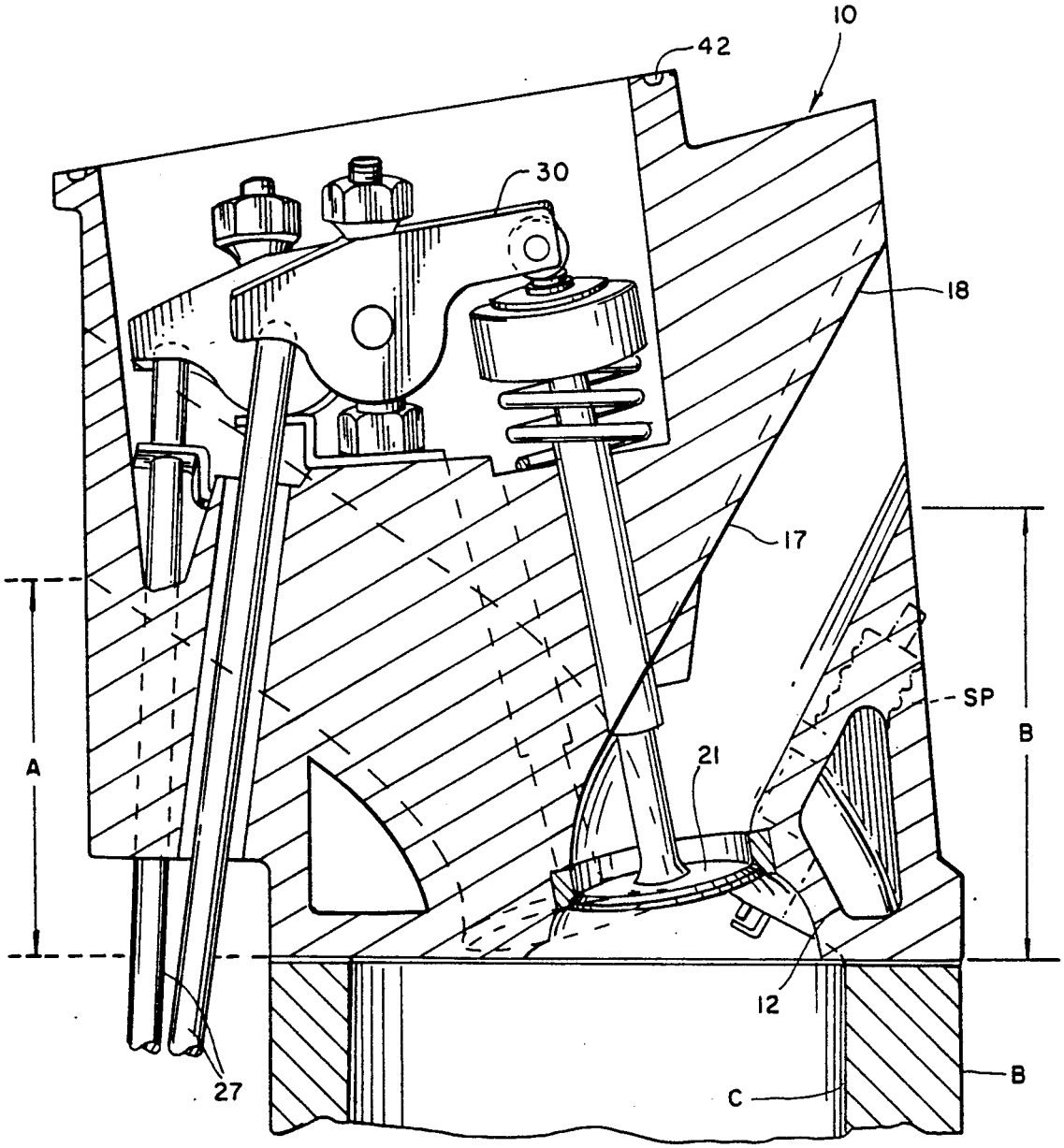
FIG. 6 is a view similar to FIG. 5, taken along line 6—6 in FIG. 2.

As seen best in FIGS. 4 and 6, the spark plug SP enters the combustion chamber at an angle of about 50° and has its tip directed generally toward the exhaust valve. This positioning of the spark plug places it approximately centrally of the combustion chamber, and together with the flow characteristics of the head, to be later described, and shape of the chamber results in good flame travel and uniform burn of the air/fuel mixture flowing across the chamber.

Figure 5:
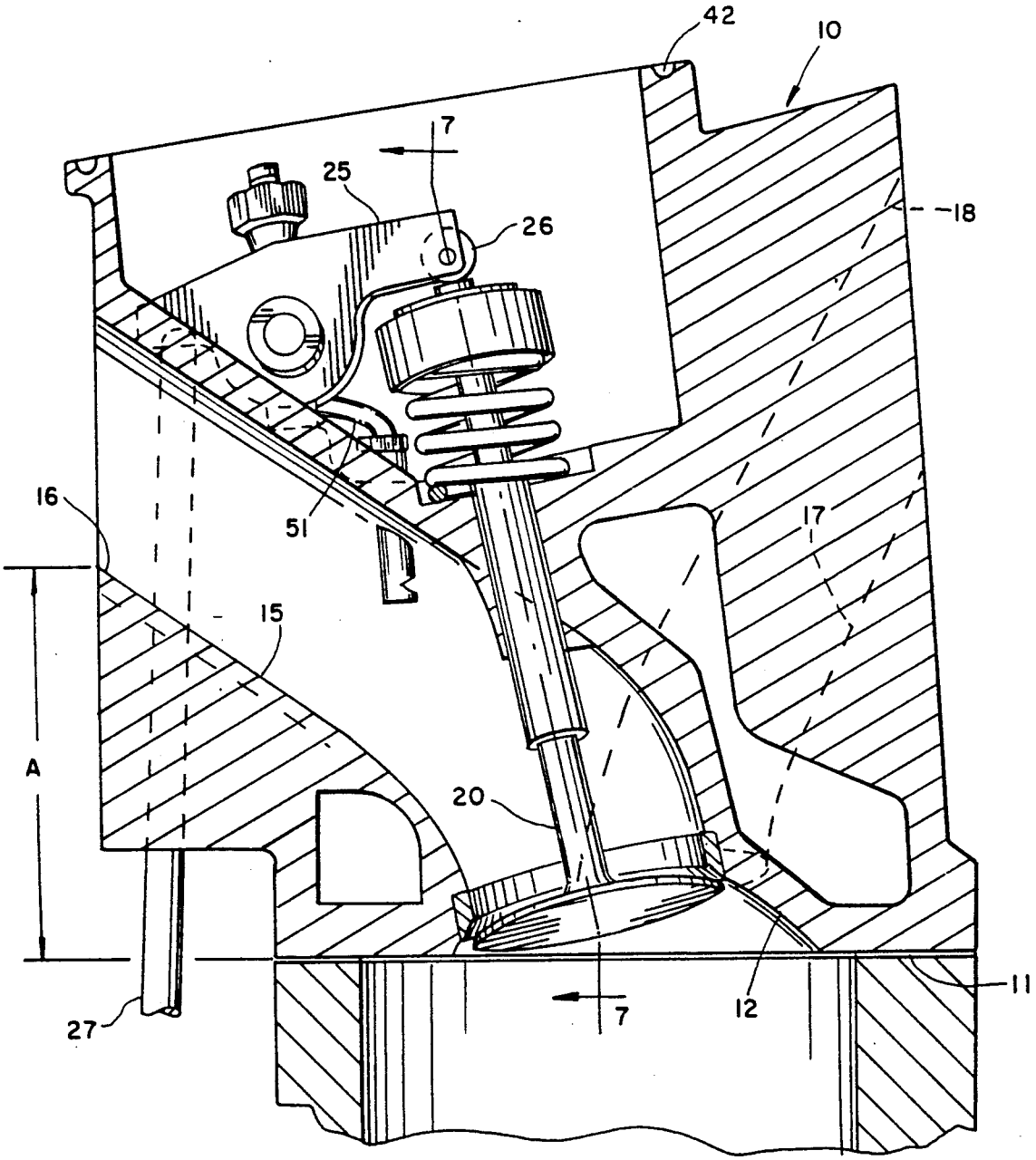
FIG. 5 is a greatly enlarged, fragmentary, transverse sectional view taken along transverse plane 5—5 in FIG. 1, through one of the intake ports.

The cylinder head 10 is substantially greater in height H than conventional wedge heads, and as seen best: in FIGS. 4, 5 and 6, the intake port 15 has its inlet end 16 raised a distance A (two inches in a specific construction) from the bottom of the head, while the outlet end 18 of the exhaust port 17 is raised a distance B (three inches in a specific construction) from the bottom. This not only enables the ports to extend nearly straight from their respective head surfaces to the combustion chamber, but results in them being substantially longer than conventional ports.

In a specific construction, for example, the roof of the intake port has a length of seven and one-half inches, while the floor has a length of four and one-half inches. The roof of the exhaust port, in this construction, has a length of five and five-eighth inches and the floor has a length of three and one-quarter inches.

Figure 2:
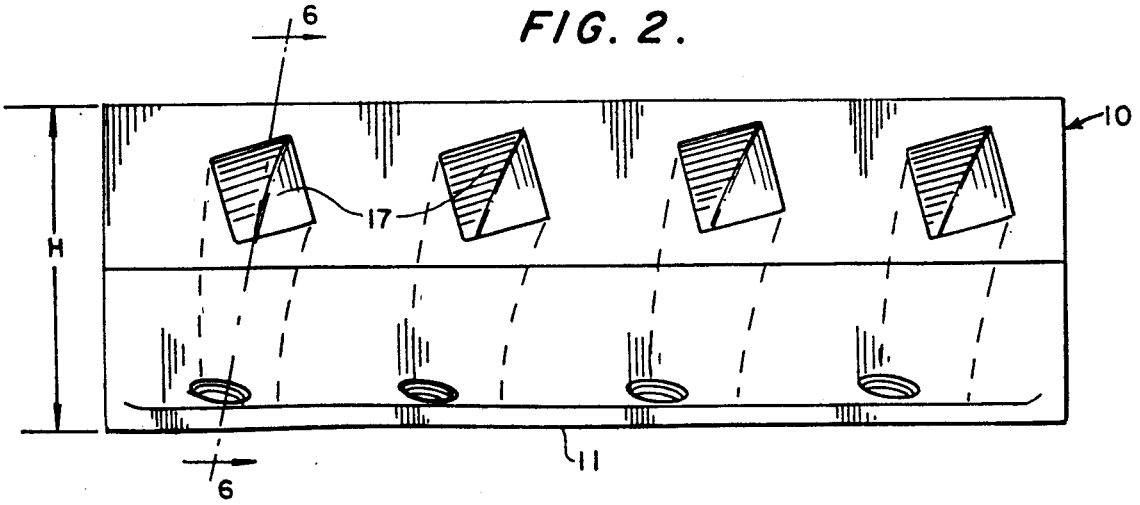
FIG. 2 is a side view in elevation of the head, looking toward the exhaust port side.

As seen best in FIGS. 1 and 2, the intake and exhaust ports are skewed in the heads, with the inlet end 16 of the intake ports and the outlet end 18 of the exhaust ports being rotated about their respective axes so that the ports angle through the heads and line up substantially axially with the axes of the respective intake and exhaust valves 20 and 21. As clearly seen in the drawings, the ports are relatively straight and bend through only a small angle with a large radius of curvature. The net result is very efficient flow of gases through the ports and exceptional breathing for the heads. Moreover, the air/fuel mixture flows spirally through the intake ports, achieving thorough admixing of the air and fuel prior to entering the combustion chamber.

As represented by the arrows in FIG. 4, the relationship between the intake and exhaust ports and the combustion chamber is such that a very smooth transition occurs from the intake port, through the combustion chamber and thence outwardly through the exhaust port. The flow of intake and exhaust gases and the location of the spark plug are very similar to the flow characteristics and spark location in combustion chambers of hemispherical design, thereby achieving the superior breathing of such heads in a wedge head design.

Figure 7:
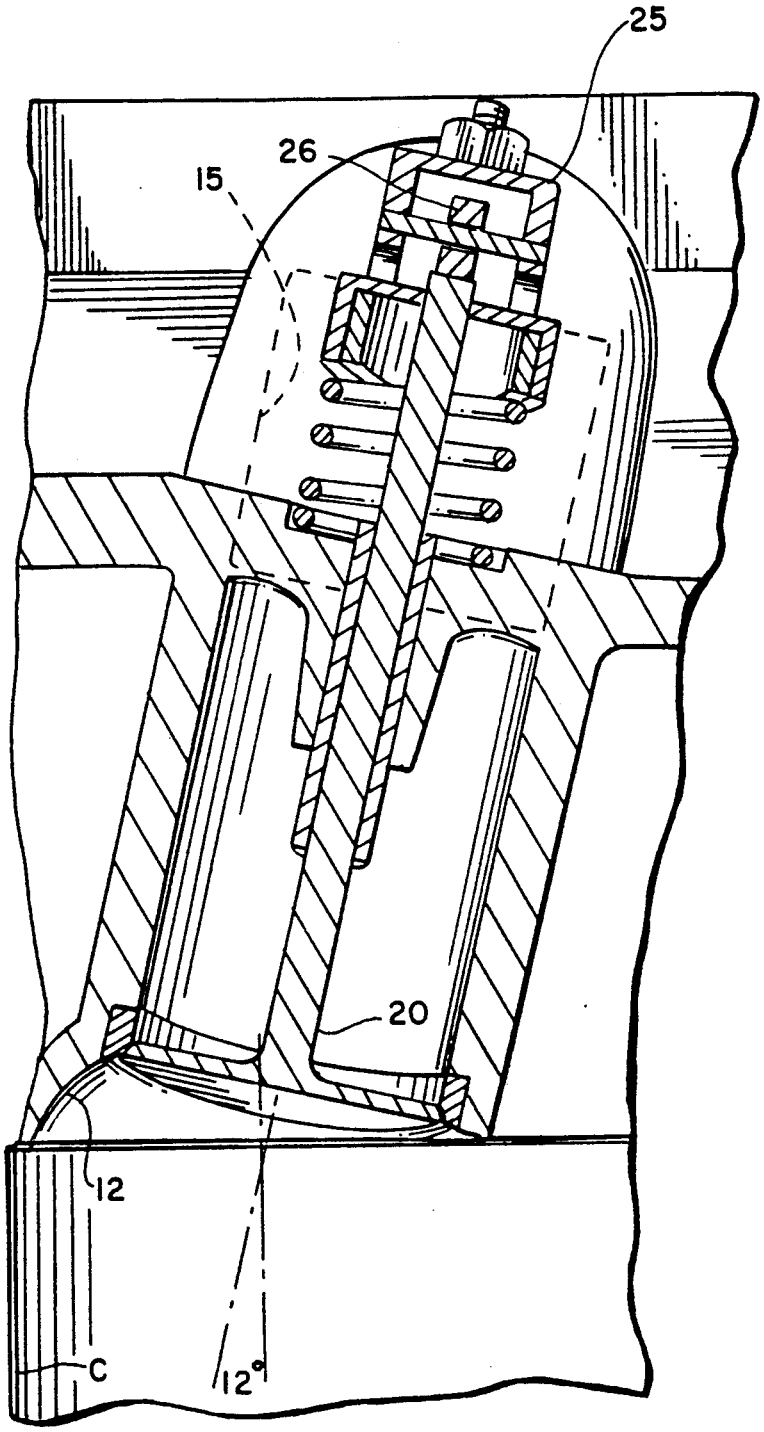
FIG. 7 is an enlarged sectional view taken along line 7—7 in FIG. 5.
Figure 8:
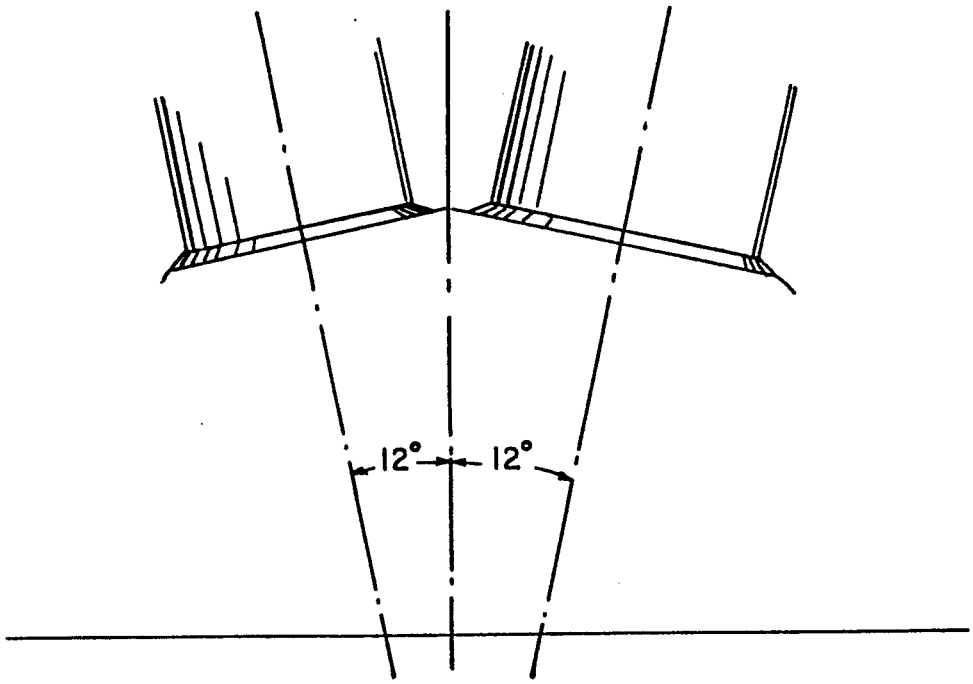
FIG. 8 is a schematic view depicting the angle of the intake and exhaust valves relative to the bottom surface of the cylinder head, considered only in the longitudinal direction of the head.

As depicted in FIGS. 5, 7 and 8, the intake valve 20 is tilted 12° in a direction parallel to the longitudinal dimension of the head (FIGS. 7 and 8) and is also tilted toward the intake side of the head to substantially axially align the valve with the axis of the intake port as it enters the combustion chamber (FIG. 5). The rocker arms 25 for the intake valves are mounted on individual studs and are inclined to match the angle of the valve stems. As shown in the particular example described and illustrated herein, roller tappets 26 are used, and conventionally positioned push rods 27 operate the rocker arms from a cam, not shown.

An exhaust valve 21 is depicted in FIGS. 6 and 8. As represented schematically in FIG. 8, the exhaust valve also is inclined at an angle of 12° in a direction parallel to the longitudinal dimension of the head, and as shown in FIG. 6 is also inclined transversely of the longitudinal dimension of the head toward its intake side. The positioning of the exhaust valve and construction and orientation of the exhaust port is such that flow of exhaust gas from the combustion chamber past the exhaust valve and through the exhaust port is very efficient. A rocker arm 30 with a roller tappet is mounted on a stud shaft for operation of the exhaust valve in a manner substantially identical to the previously described operation of the intake valve.

Figure 3:
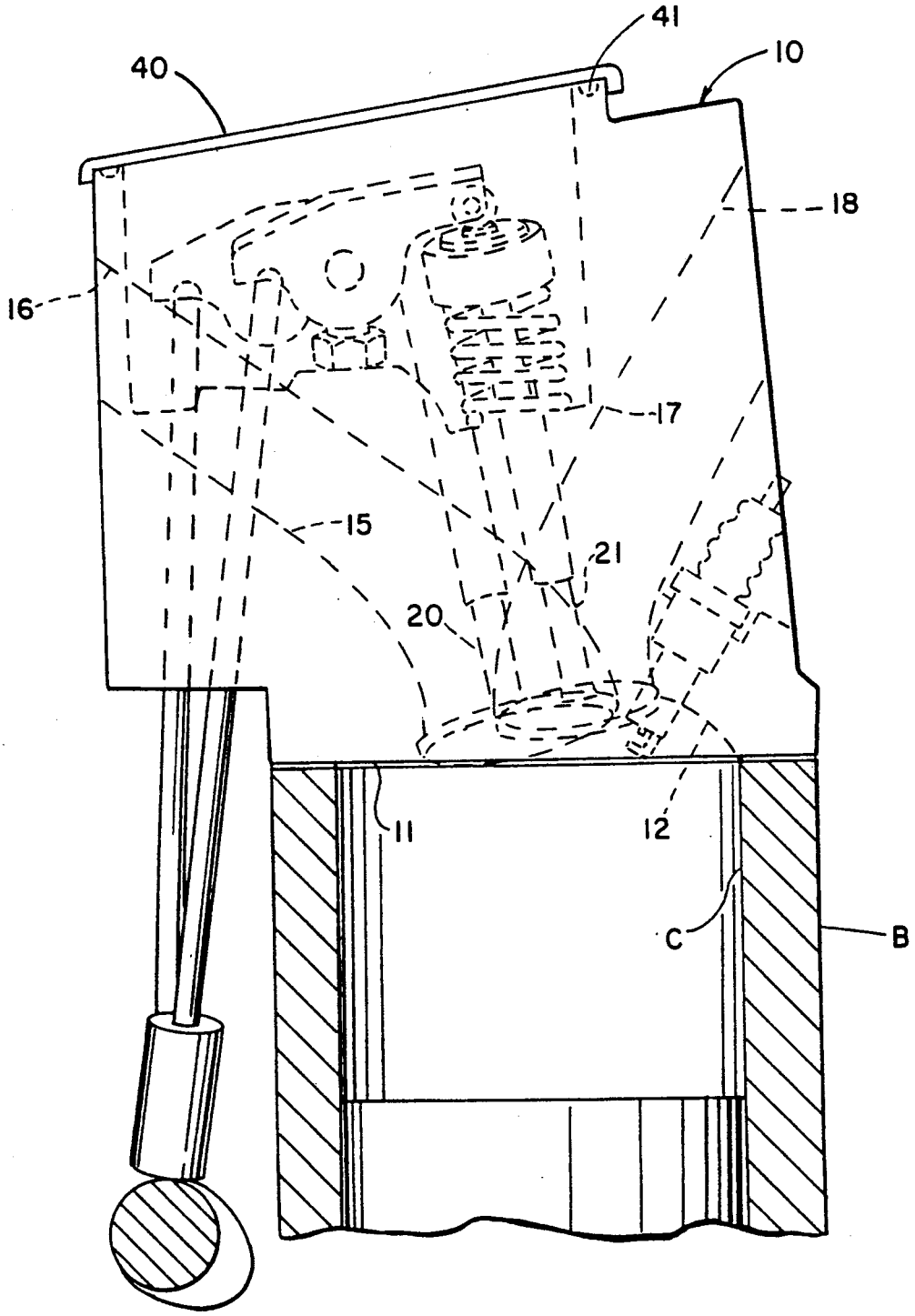
FIG. 3 is a somewhat schematic end view of the cylinder head of FIG. 1, showing a portion of an engine block cylinder in cross section.

The valve train, including the valve springs, spring retainers, rocker arms and the like, are recessed into the top surface of the head as shown best in FIGS. 3, 5 and 6. This enables a flat valve cover 40 to be used, and which may be effectively sealed to the head with an o-ring or similar sealing gasket 41 placed in an annular channel 42 formed in the top surface of the head. This arrangement virtually eliminates oil leaks which commonly occur between conventional valve covers and head surfaces, and provides more rocker clearance. Moreover, it is possible to remove and replace the valve cover without having to replace the gasket each time, as is generally necessary on conventional designs.

Figure 9:
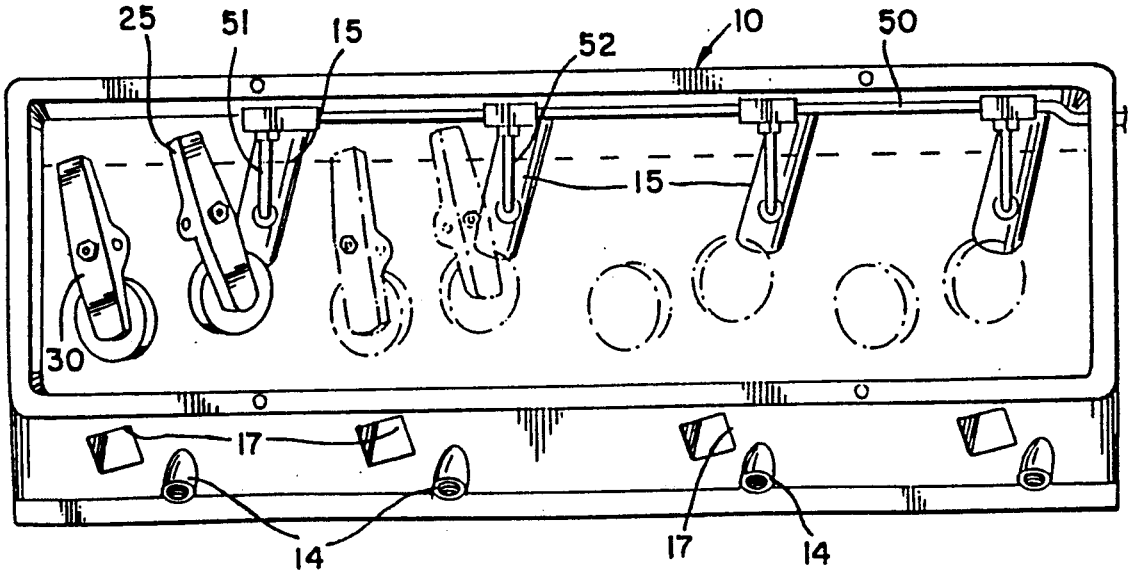
FIG. 9 is a top plan view of the cylinder head of the invention, showing an optional injection system.

If desired, fuel injection lines 50 can be extended along the top of the head, with branches 51, 52, etc. leading to respective intake ports behind the intake valves, as illustrated in FIGS. 5 and 9. These lines could be used for gasoline, alcohol, or other fuels depending upon the use of the engine.

The cylinder head shown in the drawings and described herein is configured for use on Ford engines, but obviously may be adapted to other engine designs by providing alternate means for securing the head to the engine block, and by rearranging the intake and exhaust valves to correspond to other engine designs. The increased height of the head, and the relatively straight and long ports, angled spark plug and valve orientation all as described above can be adopted to such other engine configurations, with corresponding improvements in performance.

Moreover, the substantially improved breathing achieved with the cylinder head of the invention can be utilized for increased fuel economy as well as improved performance, and can be adapted to small block engines of six and/or four cylinder design. Conventional technology, including fuel injection and computer monitoring of engine performance can be incorporated into the cylinder head of the invention, with all of the advantages achieved by such technology.

With the exception of the novel features described above, the head has an essentially conventional configuration and may be cast as easily as conventional head designs. Of course, for special applications it may be formed from a billet, if desired, and can be made of any conventional materials, such as cast iron, aluminum, etc.

It is anticipated that a normally aspirated engine equipped with cylinder heads constructed in accordance with the above could achieve two to three horsepower per cubic inch of displacement when using gasoline as the fuel; and on supercharged engines burning alcohol, up to five horsepower per cubic inch of displacement could be achieved.

The following tables show results obtained with a prototype cylinder head constructed in accordance with the invention and having the dimensions described. The tests were conducted on an SF 600 Flowbench at Engine Systems in Tucker, Ga. In conducting these tests, the ports and chambers were left unmodified, i.e., there was no special shaping or valve work to enhance performance, other than to incorporate the features of the invention.

Table 1 shows results obtained for an intake port, with the port being symmetrically oriented in the head, i.e., unskewed, as contrasted with the skewed position of the ports shown in the drawings. Tests 1, 2 and 3 were conducted on orifice four of the flowbench, which will flow 297 cubic feet per minute (CFM) at 100% efficiency. Tests 4–8 were conducted on orifice five of the flowbench, which will flow 441 CFM at 100% efficiency. All tests were conducted at 28 inches of water.

Table 2 shows results obtained for an exhaust port, again with the ports being unskewed, as contrasted with the skewed orientation shown in the drawings. All tests were conducted on orifice number four of the flowbench, and at 28 inches of water. At 100% efficiency, this orifice will flow 313 CFM.

Table 3 shows results obtained for an exhaust port under conditions identical to that for table 2, except that the port was skewed to the orientation shown in the drawings. The dramatic increase in flow obtained by the simple expedient of skewing the port is apparent from a comparison of the data in this table with the data in table 2.

TABLE 1

| | | (Intake, Unskewed) | | |
|---|---|---|---|---|
| Test No. | Valve Lift | Flow, CFM | Efficiency, % | Orifice # |
| 1 | .200 | 169 | 57.5 | 4 |
| 2 | .300 | 223 | 74.6 | 4 |
| 3 | .400 | 269 | 90.0 | 4 |
| 4 | .500 | 304 | 69.5 | 5 |
| 5 | .600 | 343 | 77.0 | 5 |
| 6 | .700 | 374 | 83.8 | 5 |
| 7 | .800 | 397 | 89.0 | 5 |
| 8 | .855 | 410 | 92.0 | 5 |

TABLE 2

| | | (Exhaust, Unskewed) | | |
|---|---|---|---|---|
| Test No. | Valve Lift | Flow, CFM | Efficiency, % | Orifice # |
| 1 | .200 | 128 | 41.0 | 4 |
| 2 | .300 | 188 | 60.0 | 4 |
| 3 | .400 | 225 | 72.0 | 4 |
| 4 | .500 | 250 | 80.0 | 4 |
| 5 | .600 | 266 | 85.0 | 4 |
| 6 | .700 | 282 | 90.0 | 4 |
| 7 | .800 | 288 | 92.0 | 4 |
| 8 | .855 | 291 | 93.0 | 4 |

TABLE 3

| | | (Exhaust, Skewed) | | |
|---|---|---|---|---|
| Test No. | Valve Lift | Flow, CFM | Efficiency, % | Orifice # |
| 1 | .200 | 138 | 44.0 | 4 |
| 2 | .300 | 191 | 61.0 | 4 |
| 3 | .400 | 235 | 75.0 | 4 |
| 4 | .500 | 263 | 84.0 | 4 |
| 5 | .600 | 282 | 90.0 | 4 |
| 6 | .700 | 293 | 93.5 | 4 |
| 7 | .800 | 302 | 96.4 | 4 |
| 8 | .855 | 310 | 99.0 | 4 |

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What is claimed is:

1. A cylinder head for an internal combustion engine, said cylinder head having a top surface, a bottom surface with means defining at least one combustion chamber therein, and opposite side surfaces, means defining an intake port leading to said combustion chamber from a side surface, and means defining an exhaust port leading from said combustion chamber to a side surface, said intake and exhaust ports extending upwardly at an angle relative to the bottom surface of the head through said head from the combustion chamber to the respective side surface and being substantially straight, said intake and exhaust ports being skewed in the head, leading angularly through the head from a respective side surface to the combustion chamber, said intake port having a generally rectangularly shaped inlet end in the head side surface, and said exhaust port having a generally rectangularly shaped outlet end in the head side surface, said inlet and outlet ends being tilted to one side in the plane of the side surface;

an intake valve being provided in said intake port for controlling flow therethrough, and an exhaust valve being provided in said exhaust port for controlling flow therethrough, said intake port and exhaust ports being substantially axially aligned with the axes of the respective valves where the ports enter the combustion chamber; and further comprising means defining a spark plug hole for each combustion chamber, said spark plug hole entering the combustion chamber approximately in the center thereof, and being angled toward the exhaust valve; and wherein the intake port angles upwardly through the head from the combustion chamber to the head side surface at an angle of about 30° to the bottom surface of the head.

2. A cylinder head as claimed in claim 1, wherein:

the exhaust port means angles upwardly through the head from the combustion chamber to the head side surface at an angle of about 60° to the bottom surface of the head.

3. A cylinder head as claimed in claim 2, wherein:

the intake and exhaust valve means for each combustion chamber are tilted in opposite directions parallel to the longitudinal dimension of the head, and the intake and exhaust port means are skewed in the head to match the angle of tilt of the respective valve means.

4. A cylinder head for an internal combustion engine, said cylinder head having a top surface, a bottom surface with means defining at least one combustion chamber therein, and opposite side surfaces, means defining an intake port leading to said combustion chamber from a side surface, and means defining an exhaust port leading from said combustion chamber to a side surface, said intake and exhaust ports extending upwardly at an angle relative to the bottom surface of the head through said head from the combustion chamber to the respective side surface and being substantially straight, said intake and exhaust ports being skewed in the head, leading angularly through the head from a respective side surface to the combustion chamber, said intake port having a generally rectangularly shaped inlet end in the head side surface, and said exhaust port having a generally rectangularly shaped outlet end in the head side surface, said inlet and outlet ends being tilted to one side in the plane of the side surface;

an intake valve being provided in said intake port for controlling flow therethrough, and an exhaust valve being provided in said exhaust port for controlling flow therethrough, said intake port and exhaust ports being substantially axially aligned with the axes of the respective valves where the ports enter the combustion chamber; and wherein the intake port angles upwardly through the head from the combustion chamber to the head side surface at an angle of about 30° to the bottom surface of the head.

5. The cylinder head of claim 4, further comprising means defining a spark plug hole for each combustion chamber, said spark plug hole entering the combustion chamber approximately in the center thereof, and being angled toward the exhaust valve.

6. The cylinder head of claim 4 wherein said intake and exhaust valve axes are each tilted at an angle of about 12 degrees away from a transverse plane of said cylinder head.

* * * * *